US009295920B2

(12) United States Patent
Aboukrat et al.

(10) Patent No.: US 9,295,920 B2
(45) Date of Patent: Mar. 29, 2016

(54) TOY MOBILE

(71) Applicant: TINY LOVE LTD., Tel Aviv (IL)

(72) Inventors: Frederik Meir Aboukrat, Hod Hasharon (IL); Ido Segal, Kefar Saba (IL)

(73) Assignee: TINY LOVE LTD., Tel Aviv (IL)

( * ) Notice: Subject to any disclaimer, the term of this patent is extended or adjusted under 35 U.S.C. 154(b) by 0 days.

(21) Appl. No.: 14/709,647

(22) Filed: May 12, 2015

(65) Prior Publication Data

US 2015/0321112 A1 Nov. 12, 2015

Related U.S. Application Data

(60) Provisional application No. 61/991,860, filed on May 12, 2014.

(51) Int. Cl.
*A63H 33/00* (2006.01)

(52) U.S. Cl.
CPC ..... *A63H 33/006* (2013.01); *A63H 33/00* (2013.01)

(58) Field of Classification Search
USPC ..... 446/227–229, 238, 484
See application file for complete search history.

(56) References Cited

U.S. PATENT DOCUMENTS

| | | | | |
|---|---|---|---|---|
| 2,994,156 | A * | 8/1961 | Steiner et al. | 446/227 |
| 6,068,535 | A | 5/2000 | Hoyt | |
| 7,025,654 | B2 | 4/2006 | Oren et al. | |
| 7,762,865 | B2 | 7/2010 | Gelfond et al. | |
| 8,771,033 | B2 | 7/2014 | Goszewski et al. | |
| 2004/0005839 | A1 * | 1/2004 | Oren et al. | 446/227 |
| 2010/0311303 | A1 * | 12/2010 | Oren et al. | 446/227 |
| 2010/0323581 | A1 * | 12/2010 | Goszewski et al. | 446/227 |

FOREIGN PATENT DOCUMENTS

| | | | |
|---|---|---|---|
| CN | 202490435 | U | 10/2012 |
| CN | 102802745 | A | 11/2012 |
| KR | 10-2012-0006604 | A | 1/2012 |
| WO | 2004/060519 | A1 | 7/2004 |
| WO | 2009/098678 | A2 | 8/2009 |

* cited by examiner

*Primary Examiner* — Nini Legesse
(74) *Attorney, Agent, or Firm* — Vorys, Sater, Seymour & Pease LLP

(57) ABSTRACT

Provided is an infant toy mobile including a hub rotatable about a first axis and at least one object support articulated to the hub and being configured for articulation thereto of at least two geometric objects, and further being configured for rotation with respect to the hub about a second axis different from the first axis.

18 Claims, 14 Drawing Sheets

TOY MOBILE

TECHNOLOGICAL FIELD

The present disclosed subject matter is concerned with an infant toy mobile. More particularly the disclosure is concerned with a powered toy mobile configured for animation of geometric objects.

GENERAL DESCRIPTION

The present disclosed subject matter is concerned with an infant toy mobile configured for supporting and selectively animating geometric objects articulated thereto.

The mobile is configured, according to one aspect hereof, such that upon animation at least some of the geometric objects are alternately exposed/hidden to an individual (e.g. a child) watching the mobile, i.e. in a peek-a-boo fashion.

In accordance with one aspect of the presently disclosed subject matter there is provided an infant toy mobile comprising a hub rotatable about a first axis and at least one object support articulated to the hub and being configured for articulation thereto of at least two geometric objects, and further being configured for rotation with respect to the hub about a second axis different from the first axis.

The second axis can transverse the first axis, and in particular can be perpendicular to the first axis.

During the rotation of the object support with respect to the hub there can be at least one disposition in which a first geometric object is at least partially concealed by a second geometric object.

In accordance with a specific example, the rotation of the object support with respect to the hub can be such that a first geometric object is alternatingly at least partially concealed by a second geometric object.

The infant toy mobile can comprise a motor unit configured for imparting a rotary motion of the hub with respect to the first axis and a rotary motion of the at least one object support with respect to the second axis.

The rotary motion of the at least one object support with respect to the second axis can be independent from the rotary motion of the hub with respect to the first axis.

The object support can comprise at least one arm having a free end to which one of the geometric objects is articulated.

The object support can be configured to articulate thereto at least one geometric object at a location other than a free end thereof.

The object support can comprise a pair of arms, each arm configured for articulation thereto of a geometric object.

The object support can further comprise a stem portion rotatingly coupled to the hub at its first end and to the pair of arms at its second end.

The infant toy mobile of claim 11, wherein the rotation of the stem portion with respect to the second axis allows rotation of the pair of arms with respect to the hub.

The object support can be a bifurcated element consisting of a first arm and a second arm.

The infant toy mobile can have at least one position in which a first arm is disposed above a second arm.

The first arm can be disposed coplanar with respect to the second arm.

The first arm can be angularly offset with respect to a second arm.

In accordance with another aspect of the presently disclosed subject matter there is provided an infant toy mobile comprising: a hub rotatable about a first axis; at least one object support articulated to the hub; and at least a first geometric object and a second geometric object configured for articulation to the object support, wherein the object support is configured for rotation with respect to the hub about a second axis different from the first axis such that during the rotation there is at least one disposition in which the first geometric object is at least partially concealed by the second geometric object.

In accordance with another aspect of the presently disclosed subject matter there is provided an infant toy mobile comprising paired geometric objects maintained by object supports, and a motorized animation system for imparting the geometric objects with at least one motion whereupon the geometric objects are alternatingly at least partially concealed by one another.

In accordance with another aspect of the presently disclosed subject matter there is provided an infant toy mobile comprising a hub rotatable about a first axis and having articulated thereto paired first geometric objects and second geometric objects; each said first and second geometric objects articulated to a first arm and a second arm respectively, said arms configured for rotation with respect to the hub about a second axis different from the first axis.

Any one or more of the following features, designs and configurations cab be applied in a toy mobile according to all the above aspects of the presently disclosed subject matter, individually or in various combinations thereof:

- According to a particular configuration, each of the first arm and the second arm extend non-coaxial with the stem portion. One of the first arm and the second arm can extend coplanar with the stem portion;
- According to a particular configuration the arrangement is such that at a top/bottom view the first arm and the second arm are (angularly offset with respect to one another), and at perpendicular view the projection of one of the arms extends above the projection of the other respective arm;
- The geometric objects are spaced apart from one another such that when one geometric object extends above another geometric object (e.g. the first geometric object above the second geometric object, and vise versa), the two geometric objects do not interfere with one another;
- The at least one object support can be rigid, i.e. having a predefined shape, or it can be deformable though stiff and configured to assume a shape imparted thereto;
- One or more of the at least one object support can extend substantially radially from the hub;
- One or more of the at least one object support can extend substantially tangentially from the hub;
- One or more of the at least one object support can extend substantially horizontally from the hub;
- The hub has articulated thereto a plurality of object supports, said object supports can be symmetrically disposed with respect to the hub;
- The first geometric object and the second geometric object can be detachably attached to the respective first and second arm;
- The first geometric object and the second geometric object articulated to the object support are related to a common theme, as far as parameters such as shape, color, pattern, texture, etc;
- The hub of the toy mobile can be carried at an end of a support post;
- The support post can be rigid or deformable though stiff and configured to assume a shape imparted thereto;
- The support post can be articulated, fixedly or in a detachably attachable fashion, to a support base;

The support base can be configured for attaching to sidewalls of a bed, crib, playpen, etc.;

The support base can be configured for standalone configuration, i.e. with the support post carrying the hub detached therefrom; in such a configuration the support base can be used as at least one of a light and a sound generator, e.g. for playing tunes or melodies with at least one of self illumination and projecting illumination;

Rotary motion can be applied to the hub through a motor received within the hub;

Rotary motion can be applied to the hub through a motor received in a support base and a drive extending through a support post carrying the hub. The motor can be used also for selective rotation of the arms carrying the first and second geometric objects;

Rotary motion to the at least one object support can be imparted by a motor received within the hub. The motor can be the same motor used for imparting rotary motion to the hub;

A controller can be provided for selectively rotating at least one of the at least one object support and the hub, and optionally the first arm and the second arm;

The hub can be constructed with a single motor configured for selective rotating at least one of the hub and the arms carrying the first and second geometric objects;

A gear coupler can be configured in the hub for selective controlling the rotation of at least one of the hub and the arms carrying the first and second geometric objects;

The object supports can be rotated at unitary speed or at different speeds, or at changing speeds, such that concealing of the respective first geometric objects takes place at matching timing or at different timing, respectively;

The first geometric objects and second geometric objects can be replaceable;

At least one of the support base and the hub and at least some of the geometric objects can be configured with one or more of illumination modules; illumination can be local illumination and/or projecting illumination;

At least one of the support base and the hub can be configured with sound generating modules;

A controller can be incorporated, at the hub or at the base unit, for controlling motion, sound and visual illuminating effects;

Any one or more of the controller and the motor and the sound generating modules and an illuminating module can be controlled by a remote control unit;

A timer can be associated with the toy mobile for programmed starting and stopping action of the system;

The toy mobile can be sound and/or motion activated;

Audio themes can be selected through RF transmission, Bluetooth transmission, socket connecting to an MP3 player and the like or it can be preprogrammed;

The power source for the one or more motor and illumination and audio modules, when provided, can be received in the base unit and/or in the hub;

According to a particular embodiment the toy mobile can be designed such that at an assembled position the hub can extend above an infant laying below, and wherein the first geometric objects are alternatingly at least partially concealed by the respective second geometric object, when viewed from below;

At least one of the first geometric object and the second geometric object can be articulated to the object support by a cord member, whereby the respective geometric object can dangle therefrom, and whereby motion of the arms imparts swinging motion to the respective geometric object;

The second geometric object can be at least partially rigid and constitutes at least a portion of the second arm of the object support. Rigidity of the second geometric object can be imparted thereto owing to properties of the material or the geometric shape thereof;

The second geometric object can have a concaved shape such that at a concealing position where it extends below the first geometric object, the first geometric object dangles from its support arm and is at least partially nested within the concavity of the second geometric object.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1:
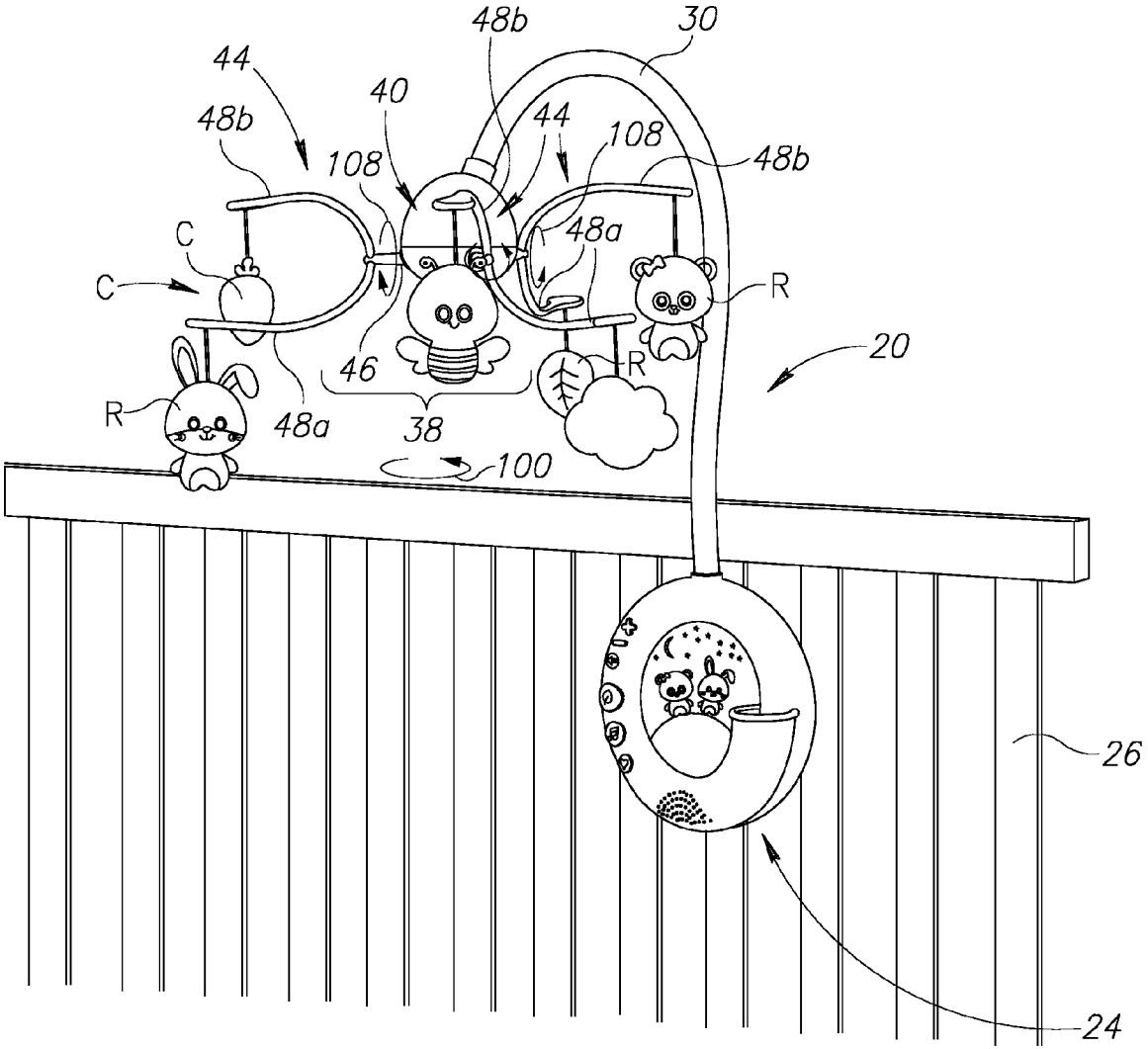
FIG. 1 is a perspective view of a toy mobile according to first example of the present disclosure, articulated to a side wall of a playpen.

Attention is first directed to FIGS. 1 and 2 of the drawings showing a toy mobile according to a first aspect of the present disclosure, generally designated 20. The toy mobile 20 comprises a support unit generally designated 24, which in the illustration of FIG. 1 is shown articulated to a side wall 26 of a playpen or the like (not shown).

The toy mobile 20 further comprises a support post 30 articulated at its bottom end to the support unit 24, and carrying at its top end a mobile assembly generally designated 38.

The support post 30 is a rigid elongates structure, which according to one example is rigidly fixed to the support base, though according to other examples is detachable attachable to the support base, however in a fixed fashion. Furthermore, according to a particular example, the base unit comprises a power source (e.g. a battery pack; not seen), whereby electric power to the mobile assembly 38 is transferred thorough electric wiring extending through the support post 30.

It is also appreciated that whilst in FIG. 1 the toy mobile is illustrated attached to a side wall 26 of an infant enclosure, the toy mobile can just as well be extend from a wall or a ceiling, or can be positioned on a surface, providing that the base unit is properly supported.

The mobile assembly 38 comprises a hub 40 (to which particular reference will be made hereinafter) to which three bifurcated object supports 44 are rotatably engaged. According to one arrangement, the bifurcated object supports 44 are detachably articulated to the hub 40. The bifurcated object supports 44 have a stem portion 46 (see also FIGS. 2 and 3) branching into a first arm 48*a* and a second arm 48*b*. Each of the first arms 48*a* and a second arms 48*b* carry at their free end a geometric mobile object which are typically themed pairs, e.g. a rabbit R and a carrot C, etc., each dangling from the free end of a respective arm by a short cord.

Figure 2A:
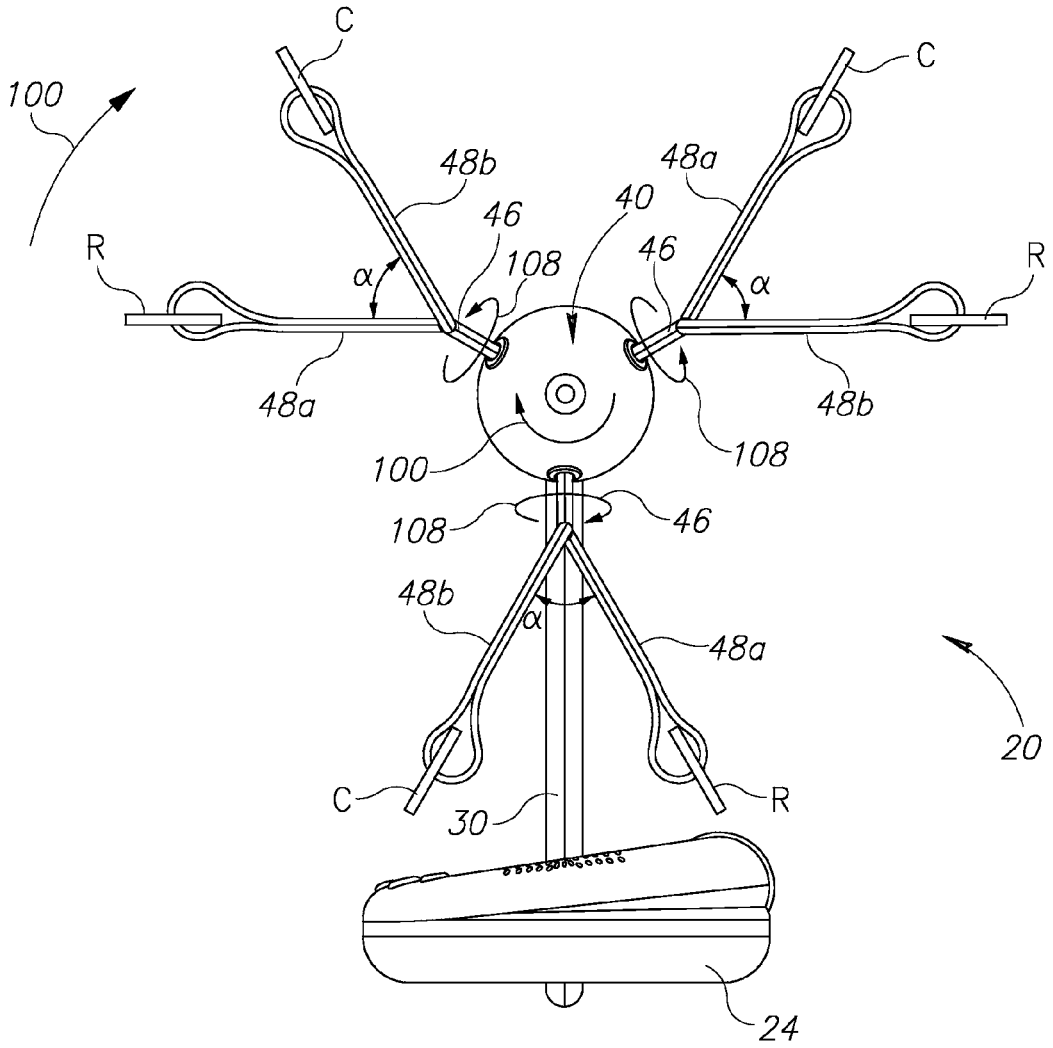
FIG. 2A is a bottom view of the toy mobile of FIG. 1.
Figure 2B:
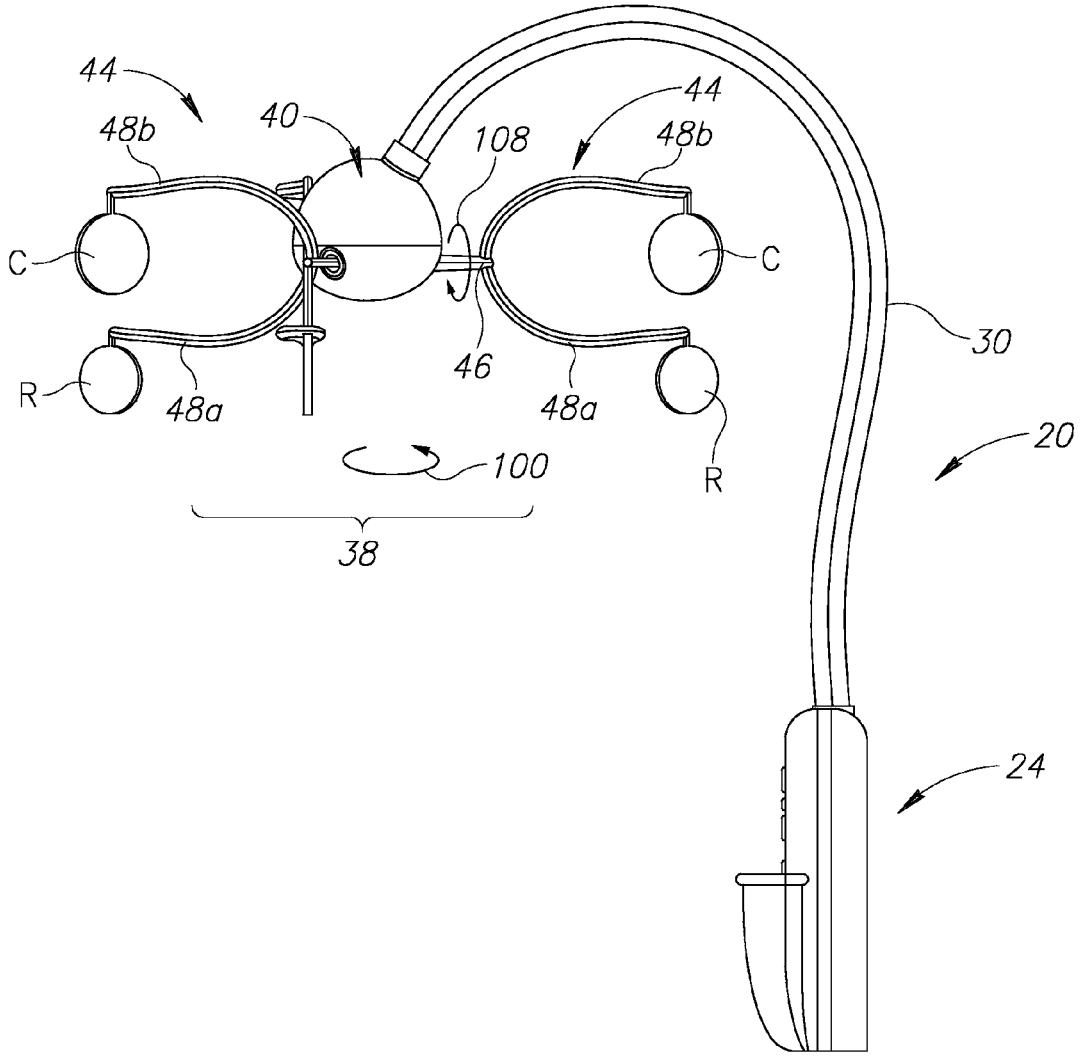
FIG. 2B is a right side view of the toy mobile of FIG. 1.
Figure 2C:
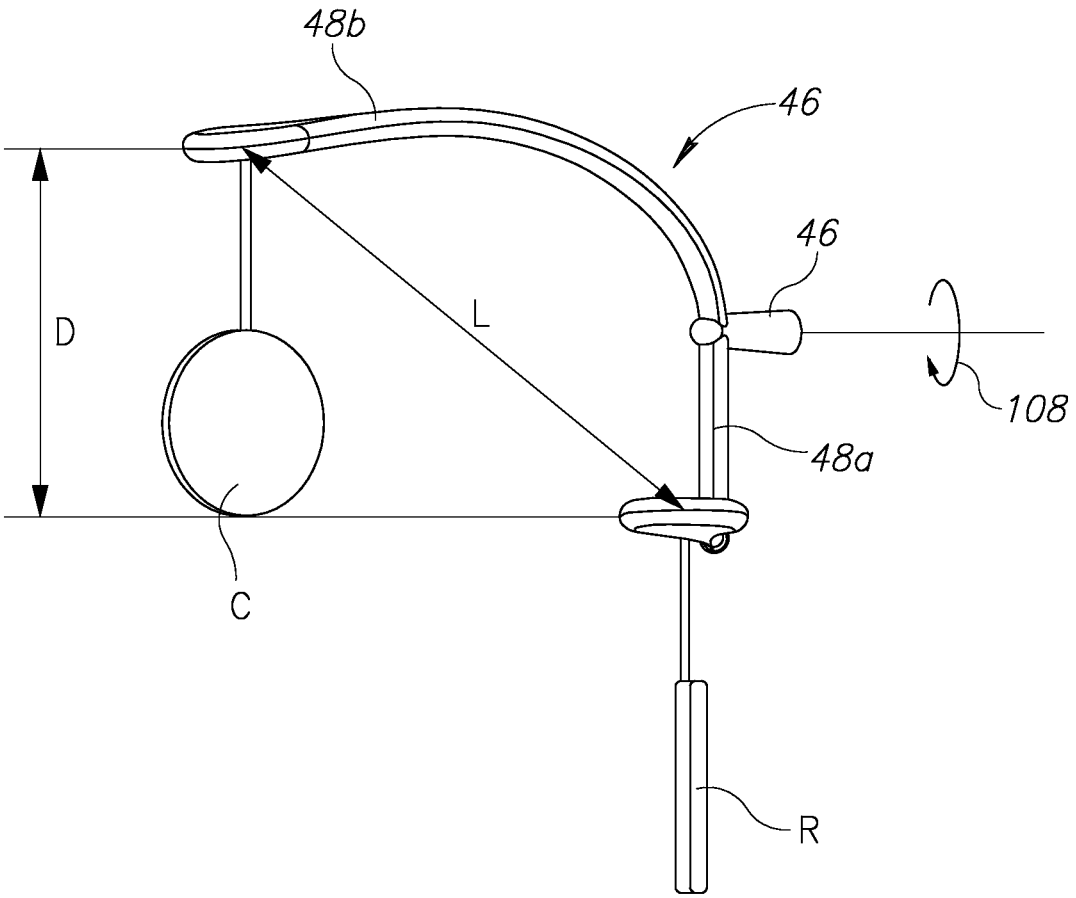
FIG. 2C is a view in direction of arrow C shown in FIG. 1.

It is noted, best in FIG. 2, that the arms 46*a* and 46*b* of an object support 44 are curved and extend non-coaxial with the stem portion 46 (FIG. 2C) and such that at a top/bottom view (FIG. 2A) the first arm 46*a* and the second arm 46*b* are angularly offset with respect to one another by angle $\alpha$, and at perpendicular view (FIG. 2B) the projection of one of the arms (48*b* in the illustration) extends above the projection of the other respective arm 46*a*. The outcome of this arrangement is such that the first arm 48*a* and the second arm 48*b* are disposed spaced apart from one another such that when one geometric mobile C object extends above another geometric mobile object R (and vise versa), the two geometric mobile objects do not interfere with one another, and will not tangle during animation thereof. It is thus seen in FIG. 2C that the vertical, planer distance D between the free end of the respective first arm 48*a* and the second arm 48*b* is shorter than the three dimensional distance L extending there between.

Figure 3A:
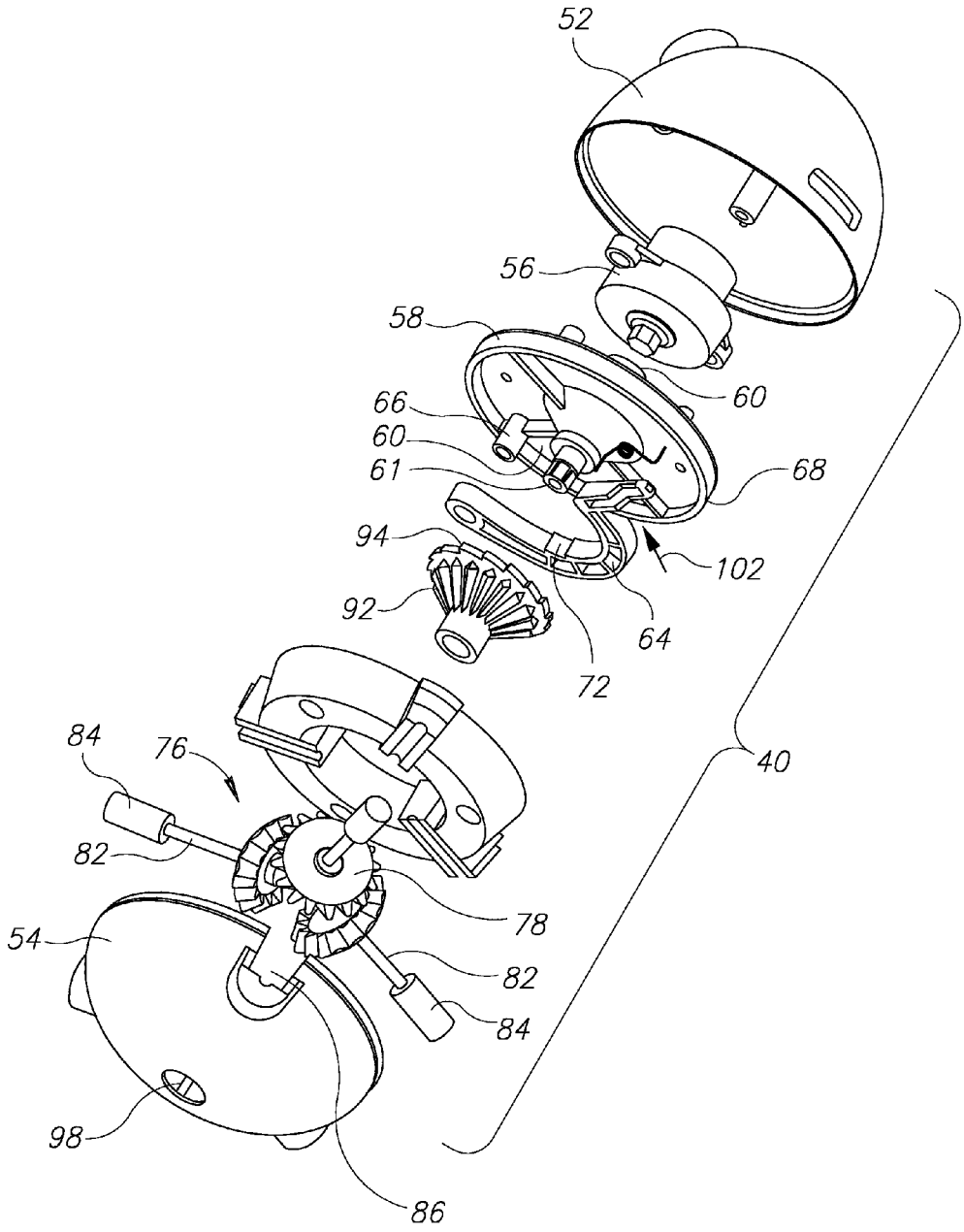
FIG. 3A is an exploded bottom perspective view of a motion unit useful in conjunction with a toy mobile according to the present disclosure.
Figure 3C:
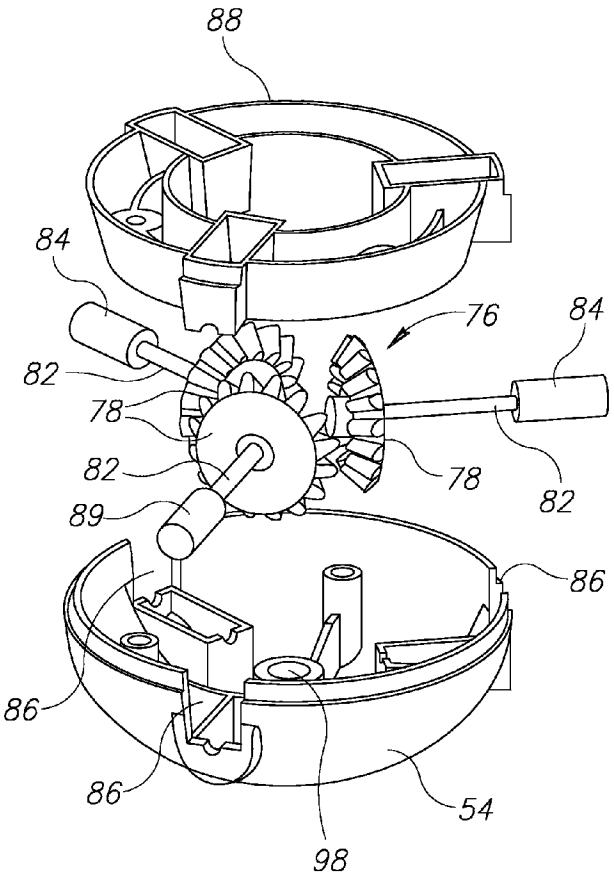
FIG. 3C is an exploded top perspective view of FIG. 3B.
Figure 3B:
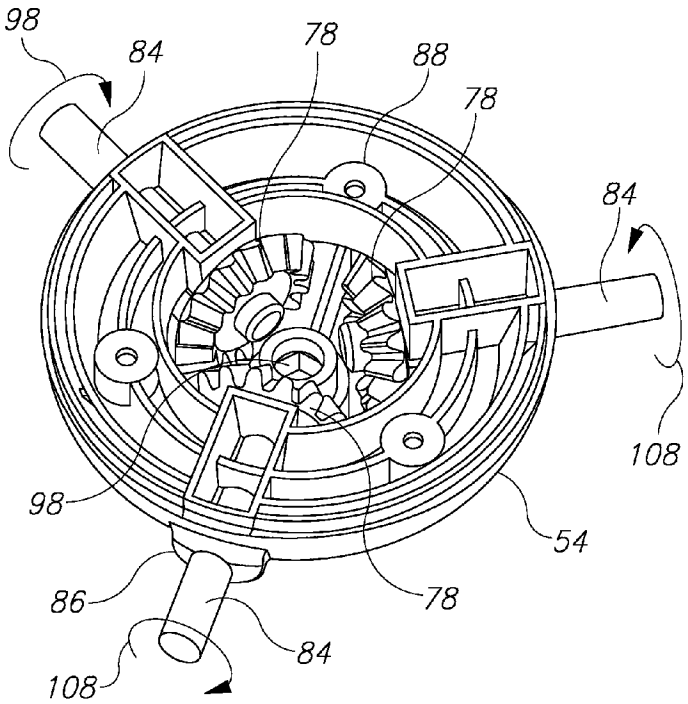
FIG. 3B is a top perspective view of a bottom portion of the motion unit of FIG. 3A.
Figure 3E:
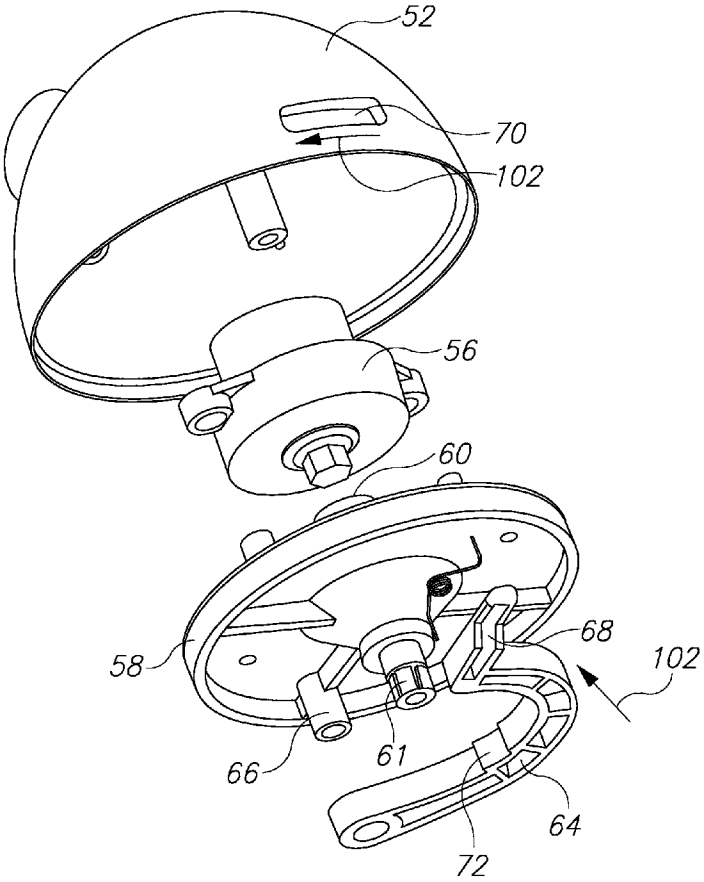
FIG. 3E is an exploded bottom perspective view of FIG. 3D.
Figure 3D:
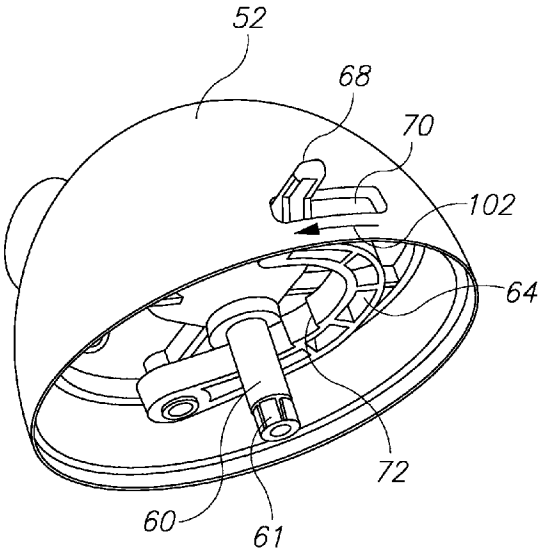
FIG. 3D is a bottom perspective view of a top portion of the motion unit of FIG. 3A.

Turning now to FIGS. 3A to 3C reference is directed to the hub 40. The hub 40 is egg-shaped and comprises a top shell 52 and a matching bottom shell 54. The top shell 52 is fixedly articulated to the top end of the support arm 30 (i.e. non rotatably). Encapsulated within the top shell 52 are provided an electric motor 56, a retaining disc 58 through which an axe pin 60 extends, said pin being coupled to an output shaft of the motor 56. A spring biased lever 64 is pivotally articulated at 66 to the retaining disc 58, with a lever arm 68 configured for projecting through as recess 70 in the top shell 52. Lever 64 is further configured with at least one arresting tooth 72, the purpose of which will be discussed hereinafter. Motor 56 is electrically coupled to a power source, e.g. a battery pack received within the support unit 24, through wires extending through the support post 30. Alternatively, a power source can be configured at the hub 40.

The bottom shell 54 is rotatably articulated to the top shell 52 and accommodates a friction gear train 76 wherein three beveled output gears 78 are equi-angularly disposed, with axles of rotation 82 disposed co-planner and each having a coupler bit 84 radially projecting from openings 86 formed at the bottom shell 54. The coupler bits 84 are configured for detachably attaching thereto an object support, such as object support 44 discussed hereinabove, or of the type disclosed herein below as will be discussed in connection with a different example.

The gear train 76 is positioned and compacted within the bottom shell 54 by a retention ring 88, screw coupled (or otherwise fastened) to the bottom shell 54. A bevel input gear 92 is disposed at a right angle to the beveled output gears 78 and is freely to rotate about the axle pin 60. The bevel input gear 92 comprises at its perimeter with several arresting teeth 94, said teeth 94 being configured for selective arresting by the arresting tooth 72 of the lever 64.

Further noted, at the assembled position, a hexagonal bottom end 61 of the axle pin 60 is engaged within a corresponding hexagonal socket 98 of the bottom shell 54.

The arrangement is such that upon activating the motor 56, rotary motion is imparted through axle pin 60 directly to the bottom shell 54 thus imparting the bottom shell rotary motion in direction of arrow 100 (FIG. 2A). Once the lever 64 is displaced in direction of arrow 102, the arresting tooth 72 of the lever 64 engages teeth 94 of the input gear 92, resulting in imparting rotary motion to the three beveled output gears 78 and thus generating rotary motion of coupler bits 84 in direction of arrows 108.

It is thus appreciated that the motor imparts rotary motion which in turn is converted into a first rotary motion of the bottom shell 54 of the hub with the articulated bifurcated object supports 44 (and the geometric objects R and C dangling therefrom) in a yaw-like motion about the center axis of the hub, and a selectively operated second rotary motion of the object supports 44 (and the geometric objects R and C dangling therefrom) in a roll-like motion about the axis of the axles 82.

Thus, during course of activating the second rotary motion (i.e. about radial axes 46 in direction of arrows 108) the dandling geometric objects R and C are animated as the arms 48*a* and 48*b* revolve, retaining their suspended position under force of gravity.

Figure 4:
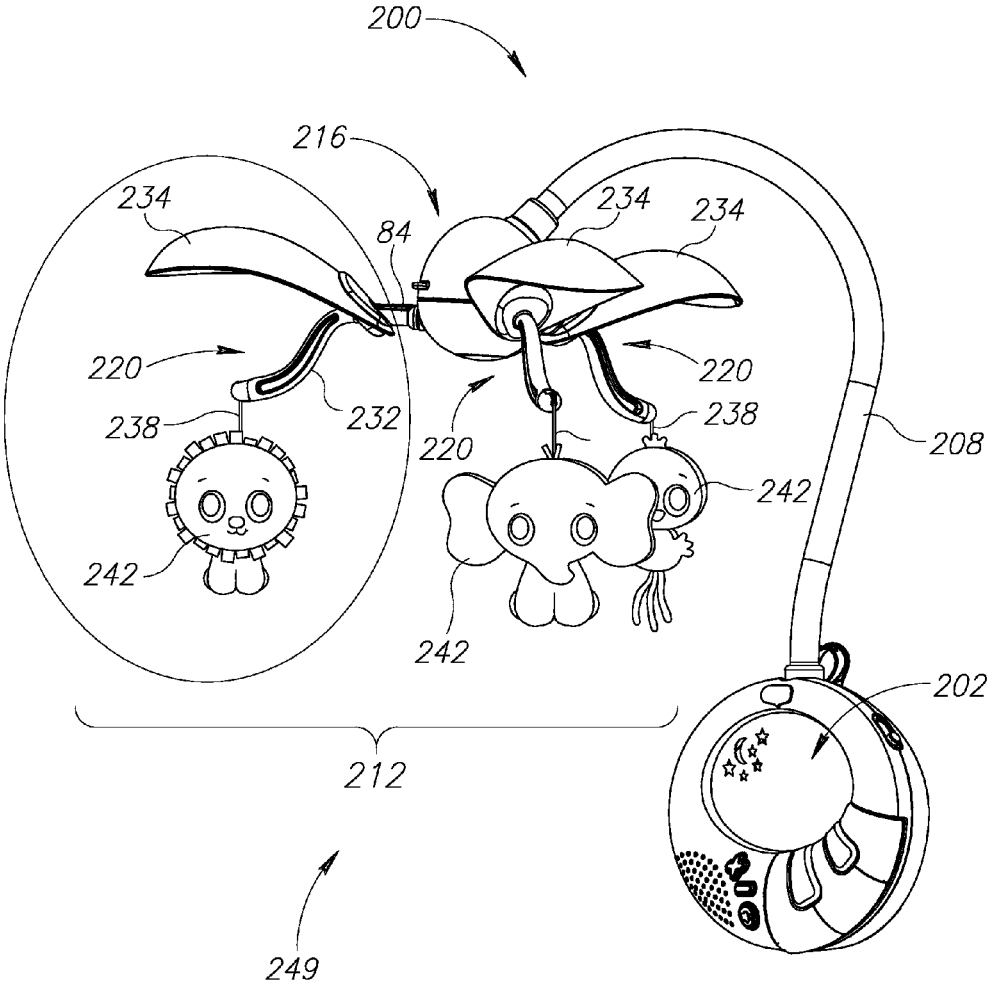
FIG. 4 is a perspective view of a toy mobile according to second example of the present disclosure.
Figure 5:
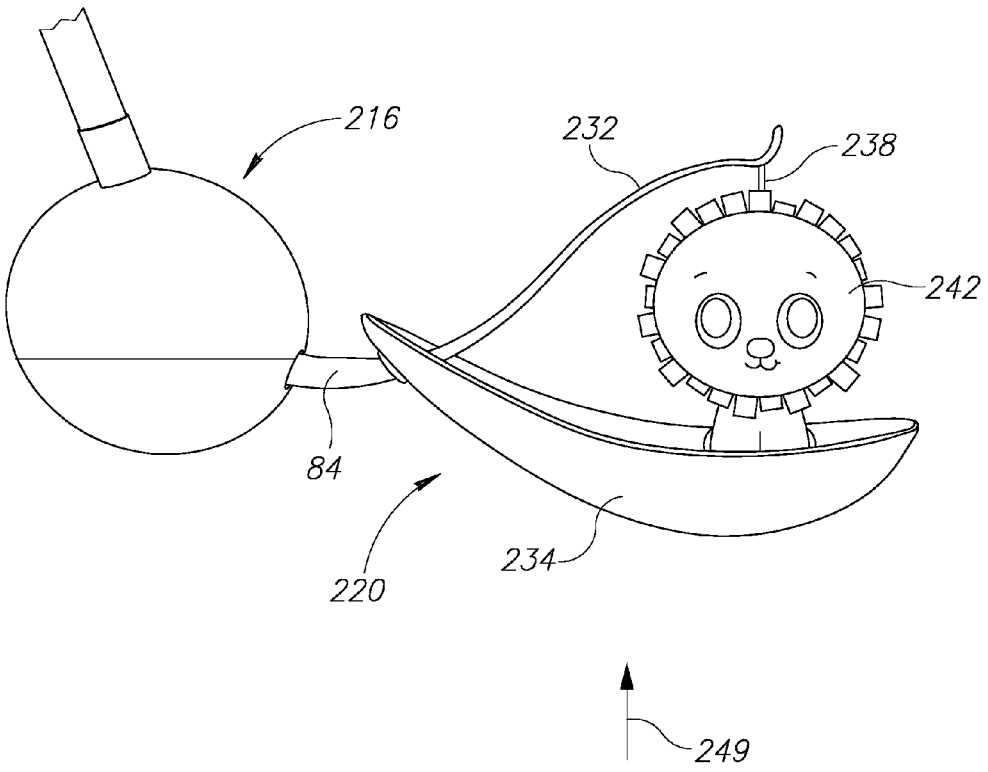
FIG. 5 illustrates the paired geometric mobile objects of the portion marked V in FIG. 4, upon completing half a revolution.

Turning now to FIGS. 4 to 6 there is illustrated a toy mobile according to a second aspect of the disclosure, generally designated 200. The toy mobile 200 comprises a support unit generally designated 202, with a support post 208 articulated at its bottom end to the support unit 202, and carrying at its top end a mobile assembly generally designated 212. The mobile assembly 212 is configured a hub 216. It is appreciated that the support unit 212, the support post 208 and the hub 216 can be substantially similar to corresponding elements disclosed in connection with the previous example, respectively, and reference is made thereto.

Articulated (fixedly or detachably) to the output couplet bits (84 in FIGS. 3A, 3B and 3C) there are object supports generally designated 220, having a generally bifurcated shape and each comprising a rigid curved first arm 232 and a concave second arm 234, the later extending from the first arm so as to give rise to the bifurcated configuration.

Dangling at a free end of the first arm 232, through a short cord 238 there is provided a first geometric mobile object 242 (animal figures in the illustrated example). The second arm 234 is leaf-like shaped constitutes a second geometric mobile object and is fanciful (e.g. the color, shape and pattern can conform in theme with the first geometric mobile object 242). It is appreciated that the dimensions of each of the first geometric mobile object 242 is selected such that it is smaller than the dimensions of the corresponding second arm 234 (namely the second geometric mobile object). This is illustrated in FIG. 5 (when viewed from below, in the direction of arrow 249) and better so in FIGS. 6A to 6K, as will be discussed hereinafter. As the motor unit (designated 56 in the previous example) is activated, a first rotary motion is imparted to the bottom shell 54 of the hub 216, with the bifurcated object supports 220 articulated thereto, rotating in direction of arrow 250 (in a yaw-like fashion, about the center axis of the hub 216). At this position the first geometric mobile objects 242 and the second arms 234 maintain their relative position.

Once the lever 68 is shifted into engagement with the input gear 92 (FIG. 3A) a second motion shifts in, wherein the bifurcated object supports 220 begin to revolve (in a roll-like fashion about the axis of the stem 84). As a result of this motion the first geometric mobile objects 242 and the second arms 234 spin about one another, whereby a first geometric mobile objects 242 are periodically/alternatingly hidden by the respective second arms 234.

Figure 6B:
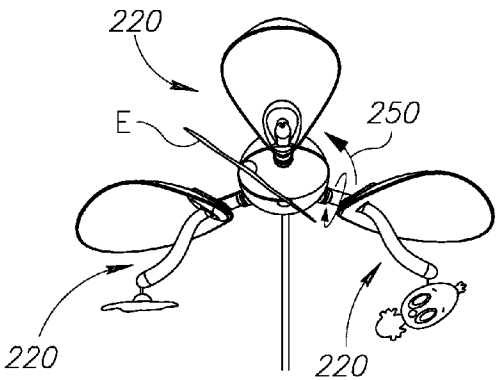
FIGS. 6A to 6K are sequential images illustrating incremental rotational displacements of the mobile, from a baby's view, viewing the mobile from below.
Figure 6D:
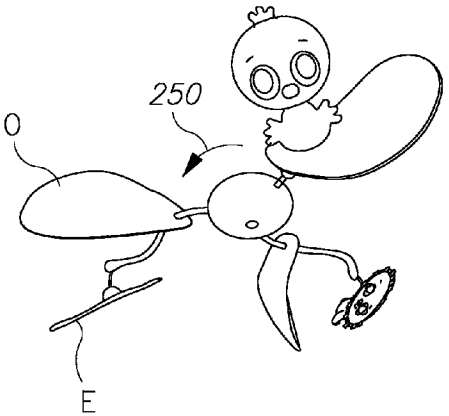
Figure 6A:
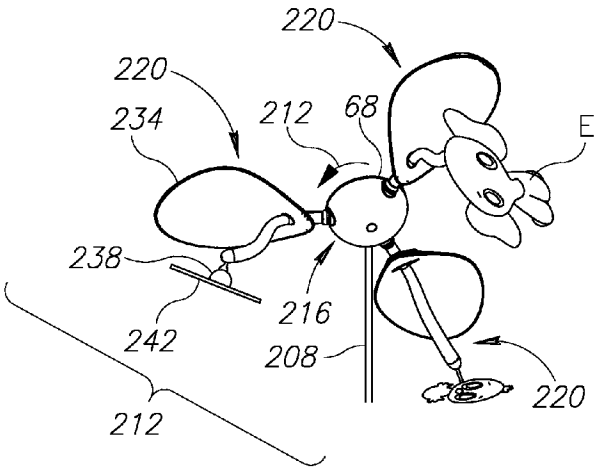
Figure 6C:
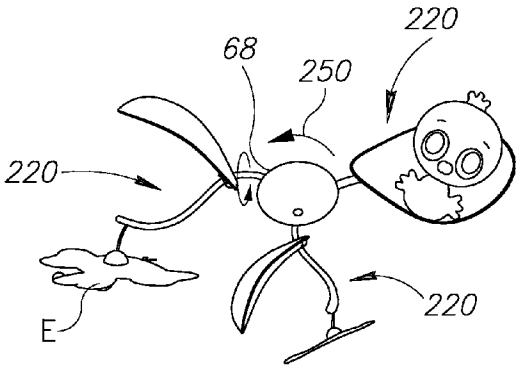
Figure 6F:
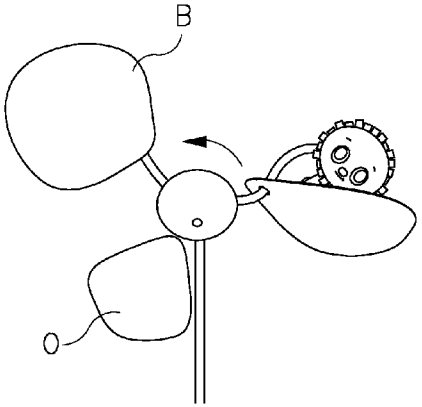
Figure 6H:
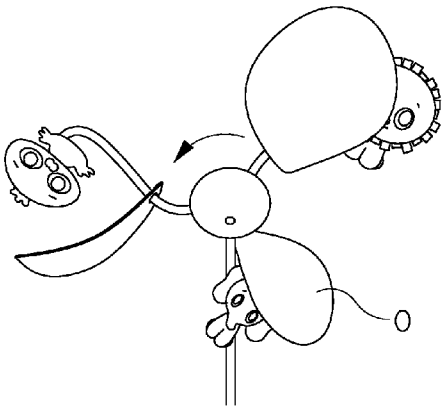
Figure 6E:
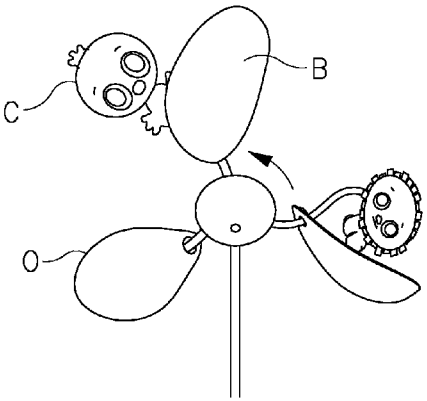
Figure 6G:
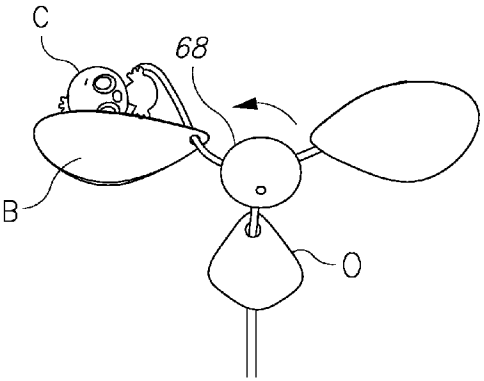
Figure 6J:
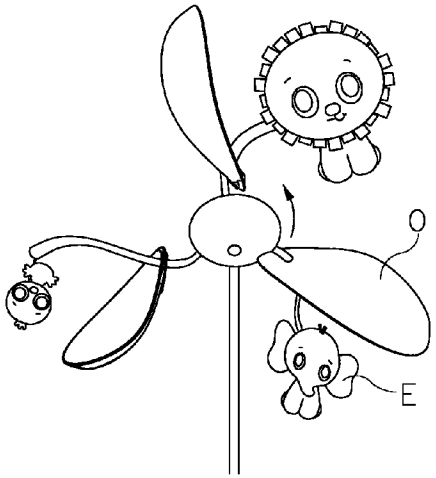
Figure 6K:
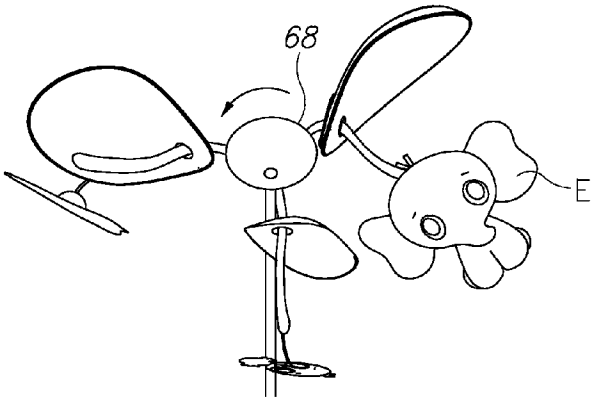
Figure 6I:
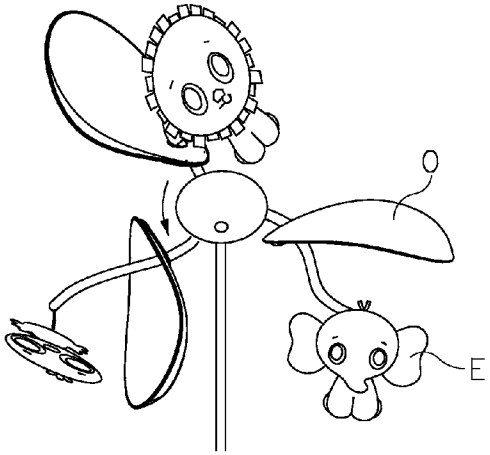

FIGS. 6A to 6K are sequential images illustrating incremental rotational displacements of the mobile, from a baby's view, viewing the mobile from below, i.e. viewed in direction of arrow 249 in FIGS. 4 and 5. It is seen that the first geometric mobile objects 242 are periodically hidden by the respective the second arms 234. In FIGS. 6E, 6F and 6G the elephant E is hidden by the Orange leaf O. likewise, in FIG. 6F the chick C is hidden by the Blue leaf B, etc.

It is appreciated that the first geometric mobile objects can be hidden simultaneously or at alternating sequences, depending at the angular setting of the bifurcated object supports 220.

This arrangement offers a child watching the mobile an animated experience, with the mobile objects playing 'hide and seek' or 'peek-a-boo' with the child.

Figure 7A:
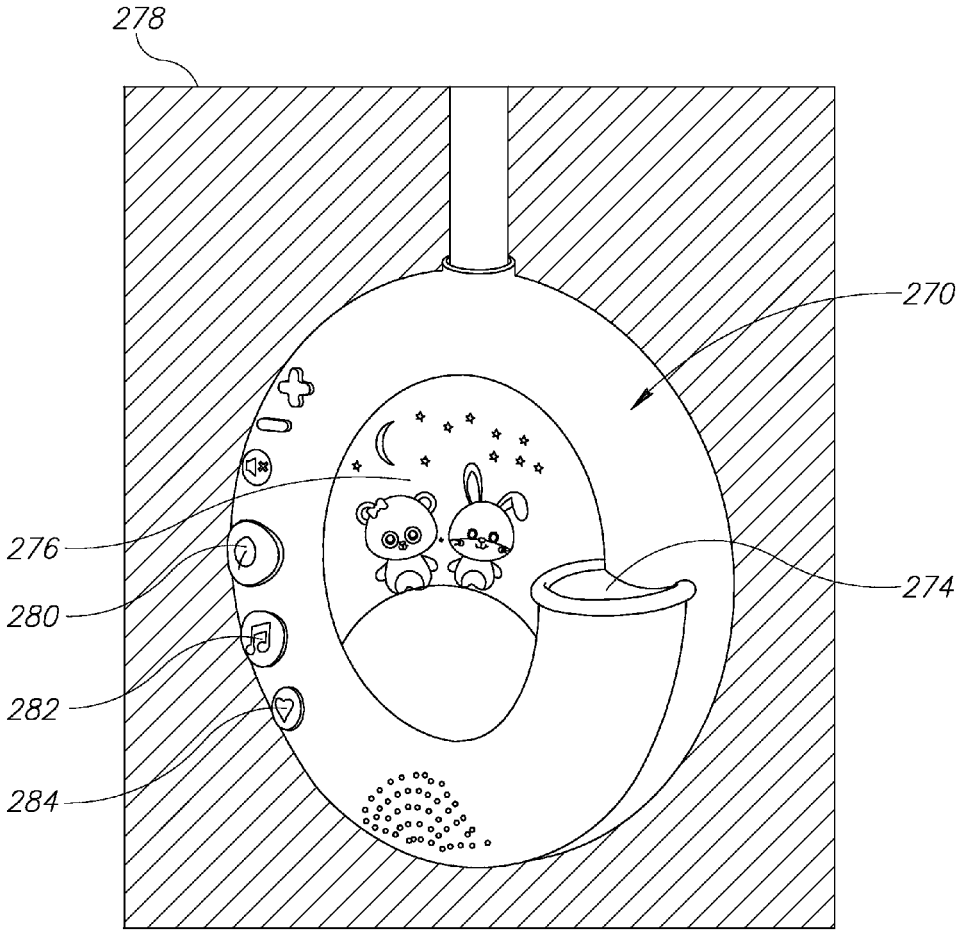
FIGS. 7A and 7B illustrate different configurations of a support unit used in a toy mobile of the present disclosure.
Figure 7B:
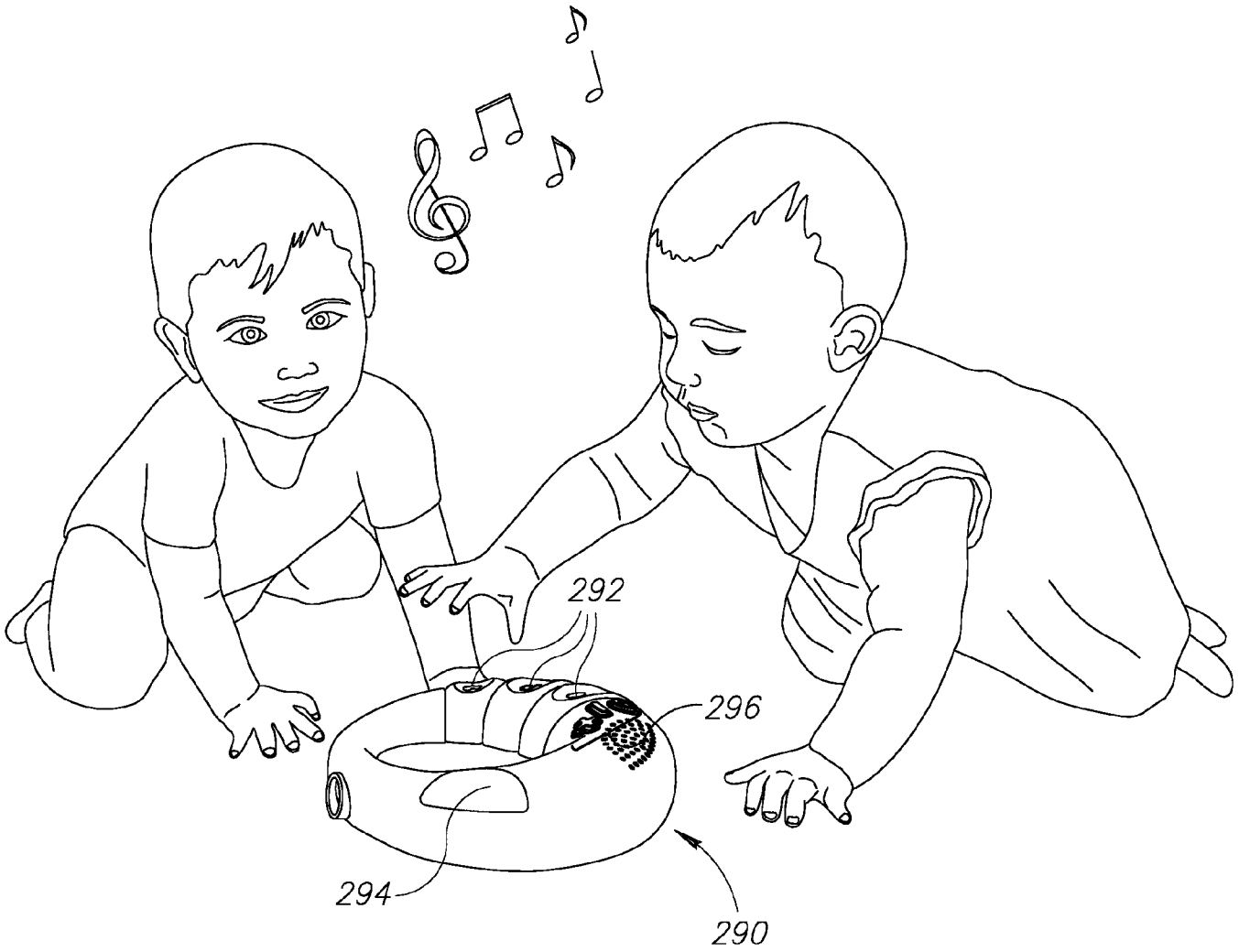

Turning now to FIGS. 7A and 7B, example of support units are illustrated, for use in conjunction with a toy mobile of the present disclosure according to either aspect thereof.

FIG. 7A illustrates a support unit generally designated 270, configured with a light projecting portion 274 for projecting light (e.g. stars or other shapes) towards a ceiling. The support unit 270 further comprises a soft illuminated image 276. A battery compartment (not seen) is provided at a back face of the support unit. This power source serves also for powering the motor unit 56 discussed above. A plurality of controls are provided, such as illumination/light controls 278, audio source select 280 (AUX port, pre-programmed chip, etc) with volume controls 282 and 284 for playing soothing sound through speaker 286.

As already mentioned herein above, the support post 30/208 can be fixedly attached to the support unit 270, or it can be detachable attachable thereto. In the example of FIG. 7B the support post 30/208 has been detached and the support unit 290 is used as a mini activity center providing sound and light activity, e.g. through a plurality of touch keys 292 and speaker 294, with volume controls 296.

The invention claimed is:

1. An infant toy mobile, comprising:

a hub rotatable about a first axis; and at least one object support articulated to the hub and being configured for articulation thereto of at least two geometric objects, and further being configured for rotation with respect to the hub about a second axis different from, and which traverses, the first axis.

2. The infant toy mobile of claim 1, wherein the second axis is perpendicular to the first axis.

3. The infant toy mobile of claim 1, wherein during the rotation of the object support with respect to the hub there is at least one disposition in which a first geometric object is at least partially concealed by a second geometric object.

4. The infant toy mobile of claim 1, wherein the rotation of the object support with respect to the hub is such that a first geometric object is alternatingly at least partially concealed by a second geometric object.

5. The infant toy mobile of claim 1, further comprising a motor unit configured for imparting a rotary motion of the hub with respect to the first axis and a rotary motion of the at least one object support with respect to the second axis.

6. The infant toy mobile of claim 5, wherein the rotary motion of the at least one object support with respect to the second axis is independent from the rotary motion of the hub with respect to the first axis.

7. The infant toy mobile of claim 1, wherein the object support comprises at least one arm having a free end to which one of the geometric objects is articulated.

8. The infant toy mobile of claim 1, wherein the object support is configured to articulate thereto at least one geometric object at a location other than a free end thereof.

9. The infant toy mobile of claim 1, wherein the object support comprises a pair of arms, each arm configured for articulation thereto of a geometric object.

10. The infant toy mobile of claim 9, wherein the object support further comprises a stem portion rotatingly coupled to the hub at its first end and to the pair of arms at its second end.

11. The infant toy mobile of claim 10, wherein the rotation of the stem portion with respect to the second axis allows rotation of the pair of arms with respect to the hub.

12. The infant toy mobile of claim 9, wherein the object support is a bifurcated element consisting of a first arm and a second arm.

13. The infant toy mobile of claim 9, having at least one position in which a first arm is disposed above a second arm.

14. The infant toy mobile of claim 9, wherein a first arm is disposed coplanar with respect to the second arm.

15. The infant toy mobile of claim 9, wherein a first arm is angularly offset with respect to a second arm.

16. An infant toy mobile, comprising:

a hub rotatable about a first axis;

at least one object support articulated to the hub; and at least a first geometric object and a second geometric object configured for articulation to the object support, wherein the object support is configured for rotation with respect to the hub about a second axis different from, and which traverses, the first axis such that during the rotation there is at least one disposition in which the first geometric object is at least partially concealed by the second geometric object.

17. The infant toy mobile of claim 16, wherein the rotation of the object support with respect to the hub is such that the first geometric object is alternatingly at least partially concealed by the second geometric object.

18. The infant toy mobile of claim 16, further comprising a motor unit configured for imparting a rotary motion of the hub with respect to the first axis and a rotary motion of the object support with respect to the second axis.

* * * * *